US008057252B2

(12) United States Patent
Sun

(10) Patent No.: US 8,057,252 B2
(45) Date of Patent: Nov. 15, 2011

(54) RJ-45 CONNECTOR

(75) Inventor: Zheng-Heng Sun, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 2 days.

(21) Appl. No.: 12/825,339

(22) Filed: Jun. 29, 2010

(65) Prior Publication Data

US 2011/0256758 A1 Oct. 20, 2011

(30) Foreign Application Priority Data

Apr. 15, 2010 (CN) ..... 201010147747

(51) Int. Cl.
*H01R 3/00* (2006.01)

(52) U.S. Cl. ..... 439/490

(58) Field of Classification Search ..... 439/490, 439/79, 344, 354, 357, 676
See application file for complete search history.

(56) References Cited

U.S. PATENT DOCUMENTS 6,457,992 B2 * 10/2002 Posey et al. ..... 439/490
7,194,183 B2 * 3/2007 Thornton et al. ..... 385/139
7,390,212 B1 * 6/2008 Yang ..... 439/490

* cited by examiner

*Primary Examiner* — Khiem Nguyen
(74) *Attorney, Agent, or Firm* — Altis Law Group, Inc.

(57) ABSTRACT

A Registered Jack-45 connector matching a connector with two light emitting diodes, includes a main body engaged with the connector, and a light guide member fitting about the main body. The light guide member includes two light guide posts. Each light guide post includes a front end aligning with and facing a corresponding light emitting diode, and a rear end opposite to the first end. The light guide posts transmit light emitted by the light emitting diodes from the front ends to the rear ends of the light guide posts.

20 Claims, 3 Drawing Sheets

RJ-45 CONNECTOR

This relevant subject matter is disclosed in a co-pending U.S. patent application Ser. No. 12/825,309 entitled "RJ-45 connector," which is assigned to the same assignee as this patent application.

BACKGROUND

1. Technical Field

The present disclosure relates to a Registered Jack-45 (RJ-45) connector.

2. Description of Related Art

RJ-45 connectors are widely used in network communication. In use, an RJ-45 connector is engaged in an interface of a chassis of a computer or a server. The interface includes two light emitting diodes, used to indicate whether the network connection is working properly. However, in most cases, the interface is defined in a rear end of the chassis, thus light generated by the light emitting diodes is only seen from the back of the chassis, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings in which like references indicate similar elements, is illustrated by way of examples and not by way of limitation. It should be noted that references to "an" or "one" embodiment in this disclosure are not necessarily to the same embodiment, and such references mean at least one.

Figure 1:
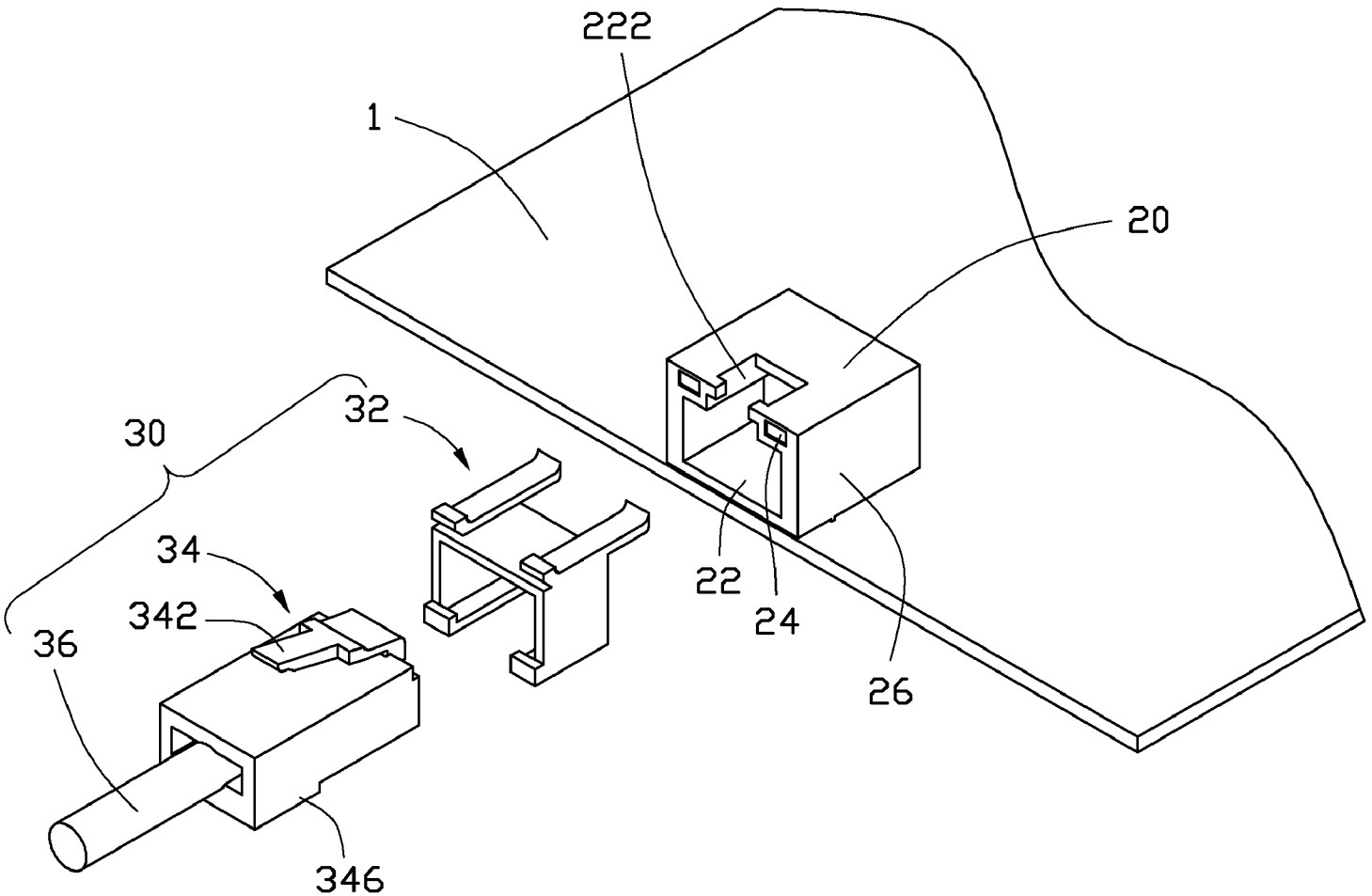
FIG. 1 is an exploded, isometric view of one embodiment of a Registered Jack-45 (RJ-45) connector and a motherboard, the RJ-45 connector including a light guide member.

Referring to FIG. 1, one embodiment of a Registered Jack-45 (RJ-45) connector 30 includes a main body 34, a light guide member 32 fitting about a rear end of the main body 34, and a cable 36 extending from the rear end of the main body 34.

An elastic latch 342 is formed on a front end of a sidewall of the main body 34 opposite to the rear end. A raised portion 346 is formed on a bottom of the rear end of the main body 34.

Figure 2:
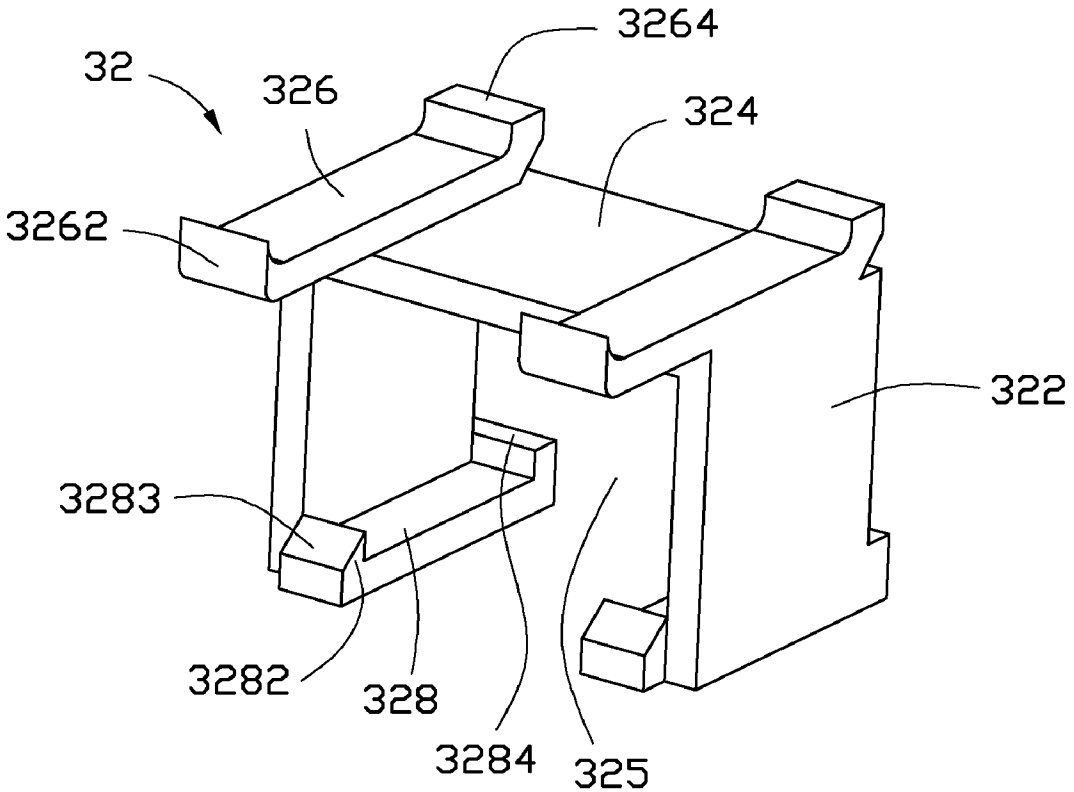
FIG. 2 is an enlarged view of the light guide member of FIG. 1, but viewed from another perspective.

Referring to FIG. 2, the light guide member 32 can be substantially U-shaped and include opposite sidewalls 322, and a supporting portion 324. Opposite ends of the supporting portion 324 are connected to tops of the sidewalls 322. The sidewalls 322 and the supporting portion 324 bound a receiving space 325.

A fixing portion 328 is formed on a bottom of each sidewall 322. The fixing portion 328 extends substantially perpendicularly from one sidewall 322 towards the other sidewall 322. The fixing portion 328 includes a first blocking portion 3282 extending towards the supporting potion 324 from a front end of the fixing portion 328, and a second blocking portion 3284 extending towards the supporting potion 324 from a rear end of the fixing portion 328 opposite to the front end. The first blocking portion 3282 can be wedge-shaped and include a slantwise top surface 3283 away from the second blocking portion 3284. Two light guide posts 326 are formed on a top surface of the supporting portion 324. The two light guide posts 326 are substantially parallel and spaced apart from each other. Each light guide post 326 includes a first end extending out of a front side of the supporting portion 324, and a second end located at a rear side of the supporting portion 324. A first protrusion 3262 extends up from the first end of each light guide post 326. A second protrusion 3264 extends upwards from the second end of each light guide post 326. The light guide posts 326 can be made of transparent plastic material.

In assembly, the main body 34 is inserted into the receiving space 325 through the front end of the light guide member 32. The raised portion 346 enters the receiving space 325 along the top surfaces 3283 of the first blocking portions 3282, and positioned between the first and second blocking portions 3282 and 3284. Opposite sides of the raised portion 346 respectively resist against the first blocking portions 3282 and the second blocking portions 3284. Thus, the light guide member 32 is fitted about the rear portion of the main body 34.

Referring to FIG. 1 again, the RJ-45 connector 30 can be inserted into a connector 20 of a motherboard 1. The connector 20 includes a housing 26. The housing 26 defines a receiving space 22. Two light emitting diodes 24 are mounted to the housing 26 above the receiving space 22. An opening 222 is defined in a top of the housing 26, communicating with the receiving space 22. The two light emitting diodes 24 are positioned at opposite sides of the opening 222.

Figure 3:
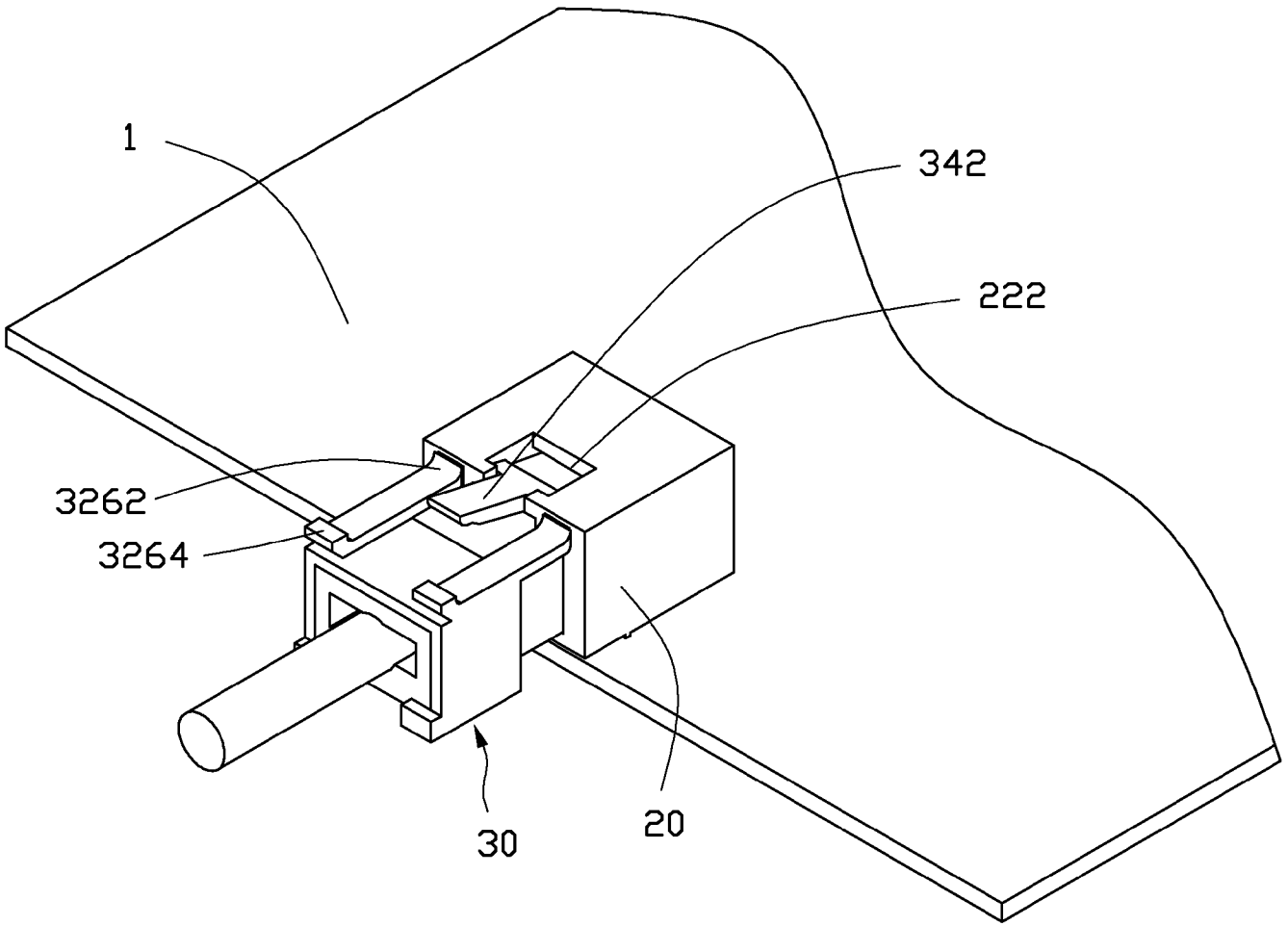
FIG. 3 is an assembled view of FIG. 1.

Referring to FIG. 3, in assembling the RJ-45 connector 30 to the motherboard 1, the connector 30 is inserted into the receiving space 22 of the connector 20. The elastic latch 342 is engaged in the opening 222. Each first protrusion 3262 aligns with and resists against a corresponding light emitting diode 24. Light generated by the two light emitting diodes 24 is transmitted to the two second protrusions 3264 located outside of an enclosure enclosing the motherboard 1. The light can be seen easily.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A Registered Jack-45 (RJ-45) connector matching a connector with two light emitting diodes, the RJ-45 connector comprising:

a main body engaged with the connector; and a light guide member fitting about the main body, and comprising two light guide posts, each light guide post comprising a front end aligning with and facing a corresponding light emitting diode, and a rear end opposite to the front end, wherein the light guide posts transmit light emitted by the light emitting diodes from the front ends to the rear ends of the light guide posts.

2. The RJ-45 connector of claim 1, further comprising a cable extending from a first end of the main body opposite to the connector.

3. The RJ-45 connector of claim 2, wherein the main body further comprises an elastic latch formed on a second end of the main body to latch with the connector.

4. The RJ-45 connector of claim 1, wherein the light guide member is substantially U-shaped and comprises two opposite sidewalls and a supporting portion connected between tops of the sidewalls, the sidewalls and the supporting portion bounding a receiving space to receive the main body.

5. The RJ-45 connector of claim 4, wherein the main body further comprises a raised portion formed on a bottom of the main body opposite to the connector, and the light guide member further comprises a fixing portion to position the raised portion formed on a bottom of each sidewall.

6. The RJ-45 connector of claim 5, wherein each fixing portion protrudes substantially perpendicularly from a corresponding sidewall towards the other sidewall.

7. The RJ-45 connector of claim 6, wherein each fixing portion comprises a first blocking portion positioned on a front end of the fixing portion, and a second blocking portion positioned on a rear end of the fixing portion opposite to the front end; the raised portion is positioned between the first and second blocking portions, and opposite sides of the raised portion respectively resist against the first blocking portions and the second blocking portions.

8. The RJ-45 connector of claim 7, wherein each first blocking portion is wedge-shaped and comprises a slantwise top surface away from a corresponding second blocking portion.

9. The RJ-45 connector of claim 4, wherein the light guide posts extend up from the supporting portion of the light guide member.

10. The RJ-45 connector of claim 9, wherein each light guide post further comprises a first protrusion extending up from a front end of each light guide post to resist against the corresponding light emitting diode.

11. The RJ-45 connector of claim 10, wherein each light guide post further comprises a second protrusion extending up from the front end of each light guide post.

12. The RJ-45 connector of claim 1, wherein the light guide posts are made of transparent plastic material.

13. A Registered Jack-45 (RJ-45) connector assembly comprising:

a first connector defining a first receiving space, and comprising a light emitting diode at a side of the first receiving space; and a second connector comprising a main body and a light guide member fitting about the main body to be received in the first receiving space together with the main body, the light guide member comprising a light guide post, the light guide post comprising a front end facing the light emitting diode, and a rear end opposite to the front end, wherein the light guide post transmits light emitted by the light emitting diode from the front end to the rear end of the light guide post.

14. The RJ-45 connector assembly of claim 13, wherein the first connector further defines an opening communicating with the first receiving space; an elastic latch is formed on the main body to engage in the opening.

15. The RJ-45 connector assembly of claim 13, wherein the light guide member is substantially U-shaped and comprises two opposite sidewalls and a supporting portion connected between tops of the sidewalls, the sidewalls and the supporting portion bounding a second receiving space to receive the main body.

16. The RJ-45 connector assembly of claim 15, wherein the main body further comprises a raised portion formed on a bottom of the main body opposite to the first connector, and the light guide member further comprises a fixing portion to position the raised portion formed on a bottom of each sidewall.

17. The RJ-45 connector assembly of claim 16, wherein each fixing portion protrudes substantially perpendicularly from a corresponding sidewall towards the other sidewall.

18. The RJ-45 connector assembly of claim 17, wherein each fixing portion comprises a first blocking portion positioned on a front end of the fixing portion, and a second blocking portion positioned on a rear end of the fixing portion opposite to the front end; the raised portion is positioned between the first and second blocking portions, and opposite sides of the raised portion respectively resist against the first blocking portions and the second blocking portions.

19. The RJ-45 connector assembly of claim 15, wherein the light guide post extends up from the supporting portion of the light guide member.

20. The RJ-45 connector assembly of claim 15, wherein each light guide post further comprises a first protrusion extending up from a front end of each light guide post.

* * * * *